US011206482B2

(12) United States Patent
Miller

(10) Patent No.: US 11,206,482 B2
(45) Date of Patent: Dec. 21, 2021

(54) MULTI-PORT WIND NOISE PROTECTION SYSTEM AND METHOD

(71) Applicant: KNOWLES ELECTRONICS, LLC, Itasca, IL (US)

(72) Inventor: Thomas Miller, Arlington Heights, IL (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 16/842,330

(22) Filed: Apr. 7, 2020

(65) Prior Publication Data

US 2020/0329310 A1 Oct. 15, 2020

Related U.S. Application Data

(60) Provisional application No. 62/832,661, filed on Apr. 11, 2019.

(51) Int. Cl.

| | |
|---|---|
| ***H04R 3/00*** | (2006.01) |
| ***H04R 3/04*** | (2006.01) |
| ***G10L 21/0208*** | (2013.01) |

(52) U.S. Cl.

CPC ..... *H04R 3/002* (2013.01); *G10L 21/0208* (2013.01); *H04R 3/04* (2013.01); *H04R 2410/07* (2013.01)

(58) Field of Classification Search

None

See application file for complete search history.

(56) References Cited

U.S. PATENT DOCUMENTS

| | | | | |
|---|---|---|---|---|
| 4,263,484 | A * | 4/1981 | Hisatsune | H04M 1/19 381/174 |
| 7,346,179 | B1 * | 3/2008 | Bobisuthi | H04R 1/086 381/174 |
| 10,631,073 | B2 * | 4/2020 | Schipper | H04R 1/086 |
| 2010/0322452 | A1 * | 12/2010 | Ladabaum | H04R 25/656 381/375 |
| 2013/0028454 | A1 * | 1/2013 | Li | H04R 25/65 381/324 |
| 2014/0233756 | A1 * | 8/2014 | Inoda | H04R 1/02 381/91 |
| 2019/0306610 | A1 * | 10/2019 | Kim | H04R 1/1075 |

* cited by examiner

*Primary Examiner* — Paul W Huber

(74) *Attorney, Agent, or Firm* — Faegre Drinker Biddle & Reath LLP

(57) ABSTRACT

A system method provides for multi-port wind noise protection. A sound may include a desired component such as speech and an undesired component such as wind. Multiple apertures on a housing receive the sound and conduct it to a microphone. The undesired component such as wind is uncorrelated at the apertures and mixes at the microphone, attenuating in amplitude while the desired component such as speech is correlated at the apertures. In this manner, the signal to noise ratio between the desired component and undesired component is improved at the microphone.

19 Claims, 7 Drawing Sheets

MULTI-PORT WIND NOISE PROTECTION SYSTEM AND METHOD

RELATED APPLICATIONS

This application claims priority to U.S. Provisional Patent Application Ser. No. 62/832,661 filed on Apr. 11, 2019, entitled "Multi-Port Wind Noise Protection System and Method," the entire contents of which are hereby incorporated by reference.

TECHNICAL FIELD

This application relates generally to wind noise protection and more particularly to a system and method for multi-port wind noise protection.

BACKGROUND

A microphone or other audio device may receive sound inputs. For example a user may speak a keyword or other spoken command to control a voice controlled user interface of a communication or other audio device. Moreover, a communication device, such as a telephone, may receive a sound input for communication to a remote device. The sound received by the audio device may include both desired and undesired portions. For instance, the sound may include the speech of a user, but may also include wind noise. The wind noise may reduce the intelligibility of the desired portion. For instance, the wind noise may obscure speech, rendering the speech difficult or impossible to decipher. Thus, there remains a need for a mechanism to ameliorate the effects of the undesired portion of the sound (e.g. wind noise) on the intelligibility of the desired portion of the sound (e.g. speech).

SUMMARY

A system method provides for multi-port wind noise protection. A sound may include a desired component such as speech and an undesired component such as wind. Multiple apertures on a housing receive the sound and conduct it to a microphone. The undesired component such as wind is uncorrelated at the apertures and mixes at the microphone, attenuating in amplitude while the desired component such as speech is correlated at the apertures. In this manner, the signal to noise ratio between the desired component and undesired component is improved at the microphone.

BRIEF DESCRIPTION OF THE DRAWINGS

For a more complete understanding of the disclosure, reference should be made to the following detailed description and accompanying drawings wherein.

DETAILED DESCRIPTION

Figure 1:
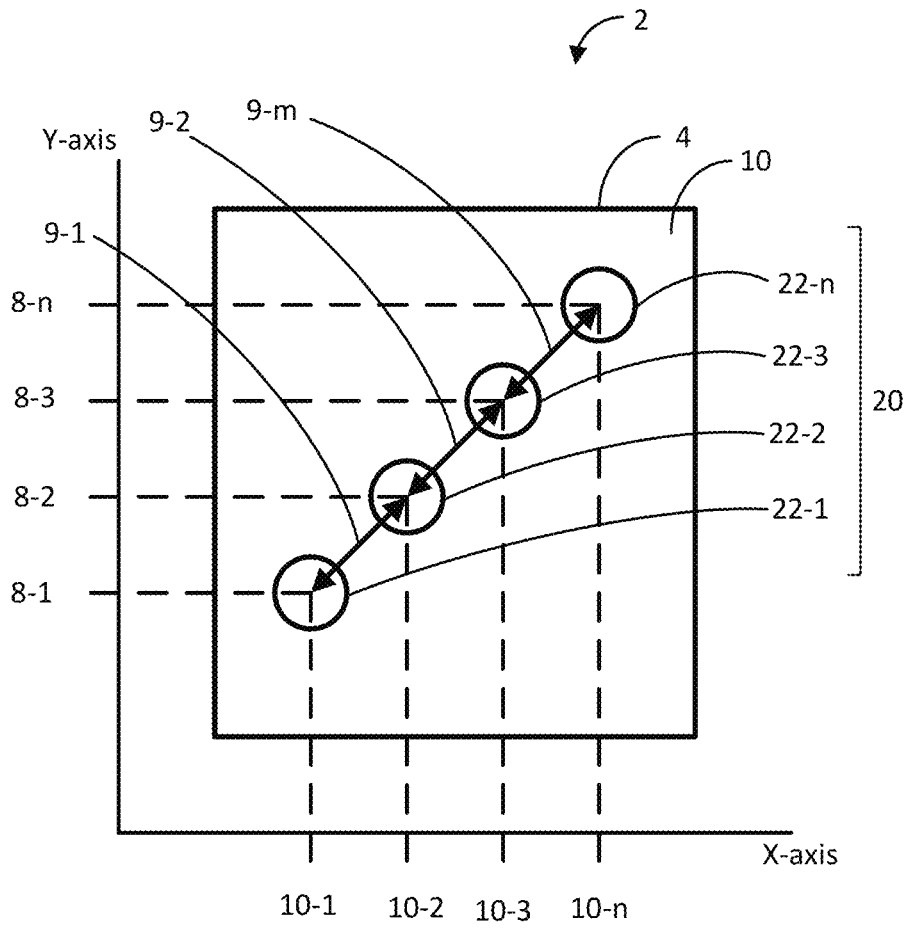
FIG. 1 depicts an example block diagram of an audio device with an aperture set disposed on a housing, in accordance with various embodiments.

Skilled artisans will appreciate that elements in the figures are illustrated for simplicity and clarity. It will further be appreciated that certain actions, blocks, and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

According to certain general aspects, the present embodiments are directed to systems and methods for multi-port wind noise protection. A multi-port wind noise protection system may be implemented to facilitate the attenuation of wind noise at a microphone of an audio device.

Generally, wind causes noise in microphones and reduces the intelligibility of desired sounds desired to be received by a microphone. Even with a wind screen present, wind noise may inhibit intelligibility of desired sounds. Various efforts to address wind noise, other than peripheral devices such as wind screens, include software processing solutions. However, software solutions may degrade machine recognition. Moreover, some wind noise mechanically stimulates a microphone's detection element in such a way as to impede the initial detection of the desired sound, limiting the ability of software solutions to recover desired sound from sound input including noise.

Systems and methods of multi-port wind noise protection are provided to address these concerns. In various embodiments, and discussed further below, it has been determined that wind generates relatively uncorrelated sound whereas speech generates relatively correlated sound when detected at a plurality of spaced apertures across a housing. For instance, rather than having a microphone inside a housing that receives sound through one passageway via a single aperture to the environment outside the housing, multiple apertures may be spaced across the housing and providing passage for sound to reach the microphone. In some embodiments, the multiple apertures are individually connected to multiple passageways leading to the microphone. The spaced apertures receive both an undesired component of a sound, such as wind noise, and a desired component of the sound, such as speech. As will be described in more detail below, the speech is correlated and the wind is uncorrelated at the spaced apertures. Thus, upon traveling down the passageway(s) to the microphone, the amplitude of the wind noise is attenuated relative to the speech due to the cancellation occurring when the uncorrelated sound waves associated with the wind are mixed at the microphone. Similarly, when the correlated sound waves associated with the speech are mixed at the microphone, the speech is not subject to the cancellation effect, and thus the signal to noise ratio of the desired component relative to the undesired component of the sound is increased. For example, in various embodiments the SNR increases by 3 dB for each doubling of the number of apertures on the housing. In various embodiments, 6 dB of attenuation of the undesired component (wind noise) may be achievable.

The apertures may have a defined size. For example, the apertures may be circular with a diameter of 0.5 to 1.5 mm. In further instances, different apertures may be different sizes. In some embodiments, apertures of a variety of sizes are contemplated. Moreover, apertures may be of different shapes as well. In various embodiments, the apertures are circular with a diameter of 0.5 mm (+/−0.1 mm). Thus, as used herein, a distance of "about 0.5 millimeters" may include from 0.4 to 0.6 mm.

The apertures may have a defined spacing. For instance, a plurality of apertures may be spaced approximately 3 millimeters (+/−0.5 mm) apart on a housing, measured between nearest edges of the apertures. Thus, as used herein, a distance of "about three millimeters" may include from 2.5 to 3.5 mm. In further embodiments, a different spacing greater than 3 millimeters is implemented. In still further embodiments, a yet different spacing is implemented. In some embodiments, a variety of spacing distances may be defined among a plurality of apertures.

Similarly, the spacing may be defined between the centers of the apertures. For instance, a plurality of apertures may be spaced approximately 3 millimeters (+/−0.5 mm) apart on a housing, measured between centers of the apertures. Thus, as used herein, a distance of "about three millimeters" may include from 2.5 to 3.5 mm. In further embodiments, a different spacing greater than 3 millimeters is implemented. In still further embodiments, a yet different spacing is implemented. In some embodiments, a variety of spacing distances may be defined among a plurality of apertures. In this manner, a 6 dB improvement of SNR as compared to a microphone with a single aperture in a housing may be exhibited by a housing having four apertures. For example, when signals are summed, an energy of the combined signal increases by 3 dB for each doubling of the number of inputs for incoherent inputs (e.g., uncorrelated) and by 6 dB for each doubling of the number of inputs for coherent inputs (e.g., correlated). An example embodiment incorporating four apertures, thus would theoretically operate as follows: (i) a combination of four incoherent wind noise inputs via four apertures would add 6 dB to the noise at the microphone, while (ii) a combination of four coherent voice inputs via four apertures would add 12 dB to the voice at the microphone. Consequently, a net 6 dB improvement in signal as compared to a microphone with a single aperture in a housing may be exhibited by a housing having four apertures.

Further consequently, electronic circuits associated with the audio device operate with greater power efficiency and lesser processing burden because the disclosed approach avoids implementation of multiple microphones or complex digital signal processing methodologies to achieve the attenuation of noise relative to signal (e.g., an attenuation of the wind component relative to the speech component of a sound).

The system and method disclosed herein has many different practical implementations. For instance, the audio device may be, or be included in, a smart speaker/microphone device, such as to facilitate voice control of home automation or information systems. The audio device may be used for voice control of appliances and/or voice communication between individuals. The audio device may communicate with other devices remotely disposed away from the audio device. The audio device may communicate with a user's mobile device to allow a user to have an audio or video call with another person far away via the mobile device and audio device.

In one non-limiting embodiment, the audio device may comprise a boom microphone (e.g. part of a headset or hearing aid including a microphone and earpiece). However, the audio device may alternatively comprise, or be included in, a smart speaker, a smartphone, a laptop, a tablet, or another electronic device. The audio device may comprise a smart microphone (i.e. a single module incorporating both a microphone and a processor such as an ASIC and/or a DSP).

With reference now to FIG. 1, a block diagram of an example audio device 2 is provided. An audio device 2 may comprise a device configured to receive an audio input and provide a corresponding electronic signal. An audio device 2 may include a housing 4 with an aperture set 20 defined through an external surface 10 of the housing 4. The aperture set 20 may comprise a plurality of apertures spaced apart on the external surface 10. For example, FIG. 1 shows an aperture set 20 comprising a first aperture 22-1, a second aperture 22-2, a third aperture 22-3, and a $N^{th}$ aperture **22-*n*. Thus one may appreciate that any number of apertures greater than one aperture may be implemented. For example, an audio device 2 may comprise an aperture set 20** with only two apertures, or with three apertures, or four apertures, or five apertures, or six apertures, or any number 'N' of apertures.

The apertures are spaced apart, as mentioned. For instance, the first aperture 22-1 and the second aperture 22-2 are shown spaced apart a first distance 9-1. Similarly, the second aperture 22-2 and the third aperture 22-3 are shown spaced apart a second distance 9-2. The third aperture 22-3 and the $N^{th}$ aperture **22-*n* are shown spaced apart by a $M^{th}$ distance 9-*m*. This spacing apart may be represented by two orthogonal vector components in a X-Y projection. For instance, the first distance 9-1 may have an X-component and a Y-component. Similarly, the second distance 9-2 may have an X-component and a Y-component, the third distance 9-3 may have an X-component and a Y-component, and the $M^{th}$ distance 9-*m*** may have an X-component and a Y-component. In various embodiments, one of the X or Y component of a distance may be zero, but the other of the X or Y component comprises the entire magnitude of the distance.

FIG. 1 illustrates the X-component and Y-component of the distances (first distance 9-1, second distance 9-2, third distance 9-3, $M^{th}$ distance **9-*m*) by depicting the location of each aperture as an ordered pair of real numbers belonging to rectangular coordinate system. For example, the first aperture 22-1 may be located at a point associated with a first X-position 10-1 and first Y-position 8-1. Similarly, the second aperture 22-2 may be located at a point associated with a second X-position 10-2 and second Y-position 8-2. Additionally, the third aperture 22-3 may be located at a point associated with a third X-position 10-2 and a third Y-position 8-3. Finally, the $N^{th}$ aperture 22-*n* may be located at a point associated with a $N^{th}$ X-position 10-*n* and a $N^{th}$ Y-position 8-*n*. While FIG. 1 shows an abstracted rectangular coordinate system in Cartesian space, one may appreciate that a practical housing 4 may have a curved external surface 10, thus the Cartesian space shown in FIG. 1 may be a planar projection of a non-planar surface 10 of a practical housing 4**.

Thus, FIG. 1 illustrates that a housing 4 may include an external surface 10. A first aperture 22-1 may be defined through the external surface 10. A second aperture 22-2 may be defined through the external surface 10. The first aperture 22-1 and second aperture 22-2 may be spaced apart on the external surface 10 by a first distance 9-1. Though not shown in FIG. 1, the first aperture 22-1 may be connected to a passageway for sound through the external surface 10 and to a microphone. Similarly, the second aperture 22-2 may be connected to a passageway for sound through the external surface and to the microphone. Consequently, the first aperture 22-1 and the second aperture 22-2 are configured to receive a sound comprising a desired component and a wind component and conduct the sound along different paths to the microphone, whereby the wind component is attenuated at the microphone relative to the desired component.

Figure 2:
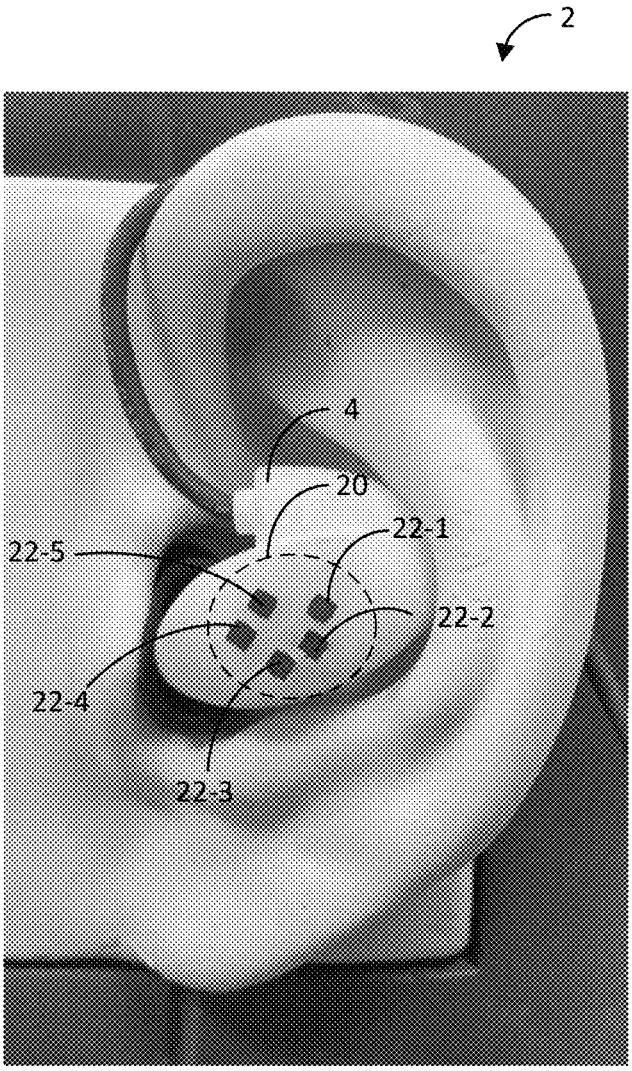
FIG. 2 depicts an example illustration of one embodiment of an audio device with an aperture set disposed on a housing, in accordance with various embodiments.

Shifting primary attention to FIG. 2, but with ongoing reference to FIG. 1, an example embodiment of an audio device 2 for use in a human ear is shown. The audio device 2 has a housing 4 that is at least partially insertable into a human ear. For instance, the audio device 2 may be part of a headset. The housing 4 comprises an external surface 10 facing away from the human ear and comprising an aperture set 20. The aperture set 20 includes a first aperture 22-1, a second aperture 22-2, a third aperture 22-3, a fourth aperture 22-4, and a fifth aperture 22-5. Each aperture is spaced apart from each other aperture. A sound comprising a desired component and a wind component is received at a plurality of the apertures and conducted by one or more passageways (not shown) to a microphone. In this manner, the sound travels along different paths to the microphone. At the microphone, the wind component is attenuated relative to the desired component, as will be described in more detail below. Though not shown in FIG. 2, the microphone may be inside a cavity at least partially enclosed by the external surface 10 of the housing 4. Thus, a headset with an internally disposed microphone may implement a multi-port wind noise protection system.

Figure 3:
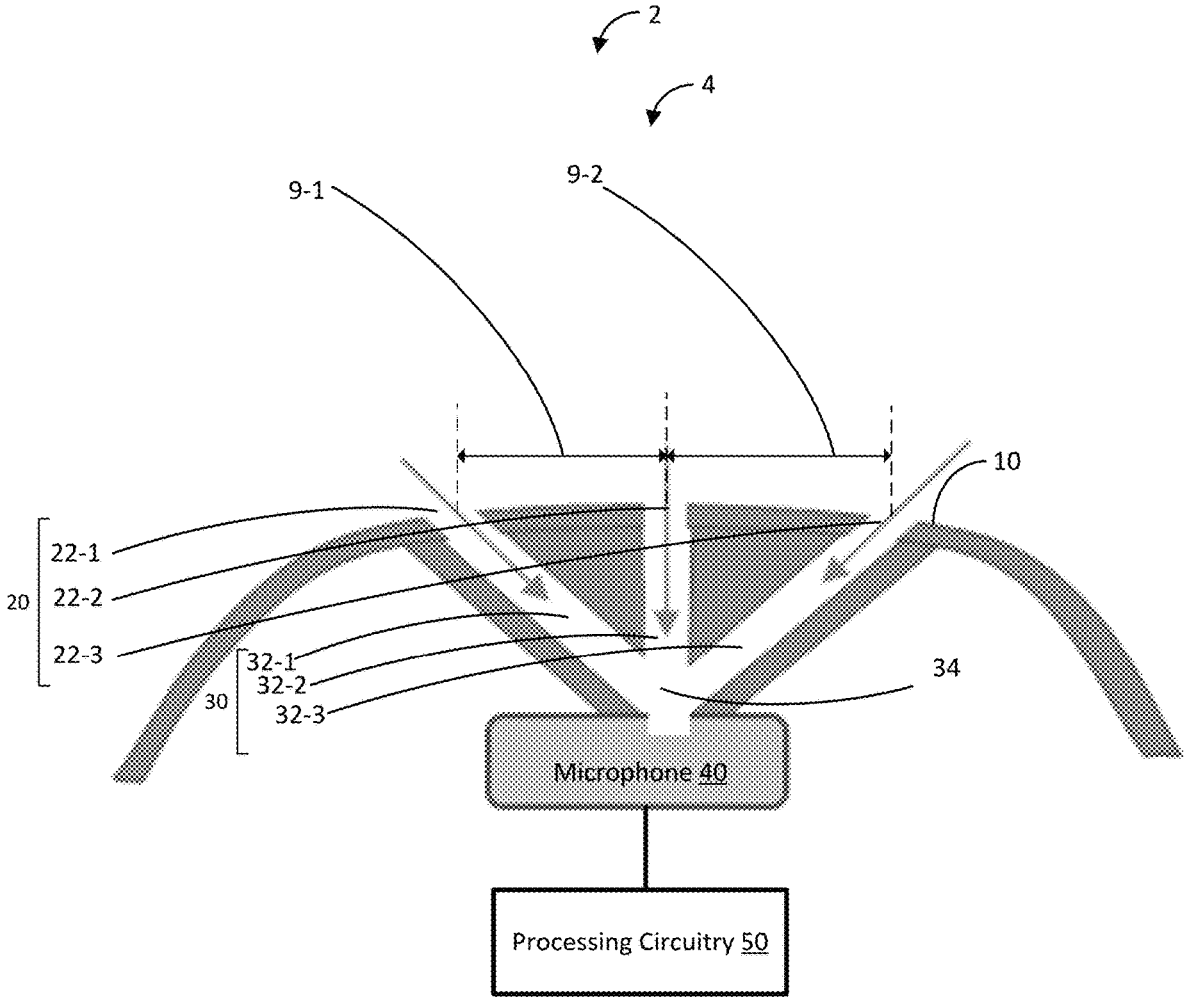
FIG. 3 depicts an example cutaway side view of one embodiment of an audio device with an aperture set disposed on a housing and depicting a passageway set through the housing, in accordance with various embodiments.

Turning now to FIG. 3, additional aspects of an audio device 2 having a multi-port wind noise protection system are shown. The housing 4 may include an external surface 10 and an aperture set 20 as previously mentioned. However, FIG. 3 shows a further aspect of the housing 4, specifically a passageway set 30. The passageway set 30 comprises a plurality of passageways defined through the housing 4 that connect the apertures to the microphone 40 via cavity 34. In various embodiments, each aperture is associated with a unique single passageway. For example, a first aperture 22-1 is associated with a first passageway 32-1, a second aperture 22-2 is associated with a second passageway 32-2, and a third aperture 22-3 is associated with a third passageway 32-3. In various embodiments having "N" apertures, "N" passageways are also present. Thus, a passageway set 30 may include a first passageway 32-1, a second passageway 32-2, a third passageway 32-3, and a $N^{th}$ passageway 32-N (not shown).

Figure 6:
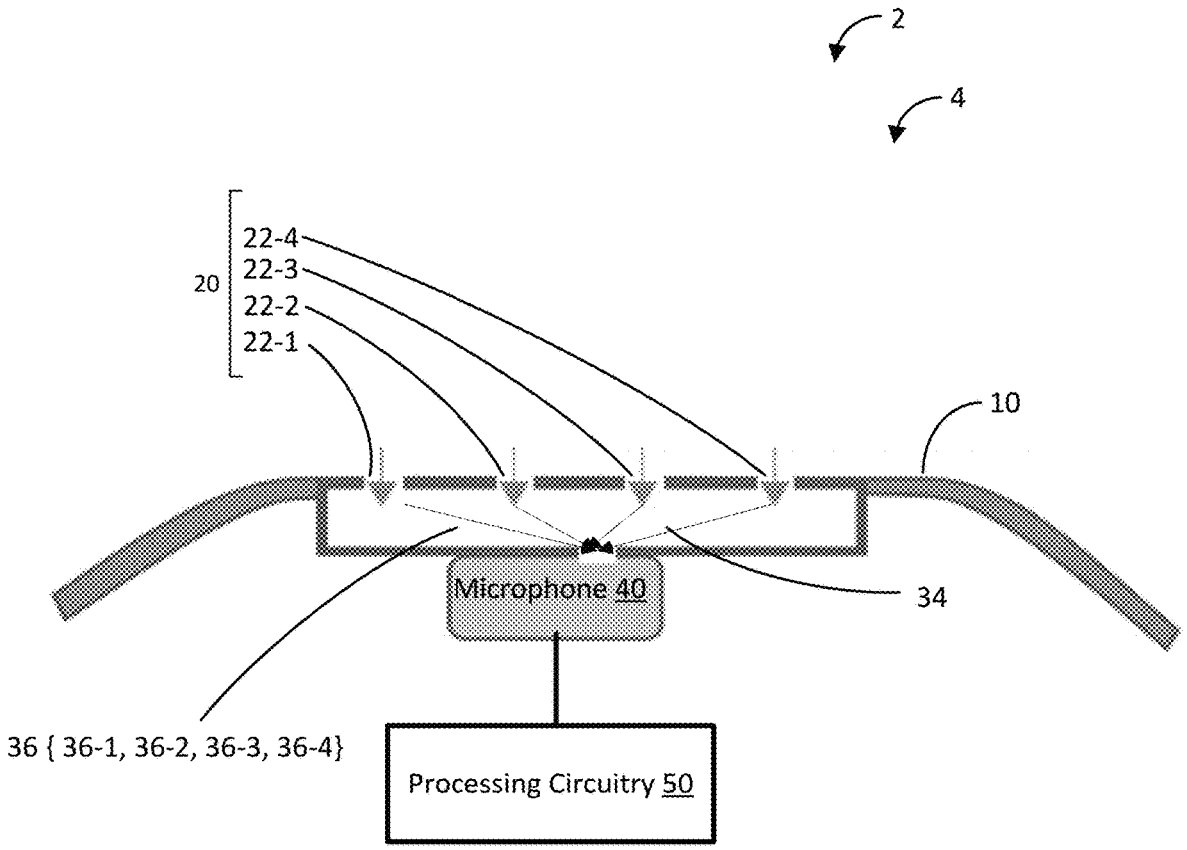
FIG. 6 depicts an example cutaway side view of one embodiment of an audio device with an aperture set disposed on a housing and depicting a passageway set through the housing, the passageway set having a single shared passageway, in accordance with various embodiments.

Other configurations are also contemplated, for instance, wherein the apertures open directly into a shared passageway or cavity 34. For example, FIG. 6 depicts an audio device 2 having a multi-port wind noise protection system with a cavity 34 and no passageway set 32. The housing 4 may include an external surface 10 and an aperture set 20. Each aperture of the aperture set 20 connects to a cavity 34, including a first aperture 22-1, a second aperture 22-2, a third aperture 22-3 and a fourth aperture 22-4. While four apertures are depicted, other numbers of apertures are contemplated as well. Thus, an audio device 2 having a cavity 34 may have any number of apertures connected to the cavity 34 (either directly in FIG. 6 or via passageways as in FIG. 3). Moreover, in various embodiments that can be adapted from the embodiment of FIG. 3, subsets of the apertures set may have unique shared passageways. For instance, a first collection of apertures may share one passageway while another collection of apertures may share a different passageway. Any number of apertures sharing any number of passageways may be provided.

Directing attention to FIG. 3, each passageway 32-1, 32-2, 32-3 may have a cross-sectional shape. For instance, a passageway may be tubular, having a circular cross-sectional shape. The passageway may have a trapezoidal cross-sectional shape, or may have any cross-sectional shape. In addition, the cross-sectional shape of the passageway may be different at different positions, so that the passageway has a non-constant cross-sectional shape.

Each passageway 32-1, 32-2, 32-3 may have a path profile. For instance, a passageway may follow a straight line, or may follow a curved path, or may follow a combination of straight lines and curves, or may have any path as desired.

FIG. 3 and FIG. 6 further depict microphone 40 in communication with cavity 34 via an opening in the microphone for example. The microphone 40 generates an electronic signal for a processing circuitry 50 based on the sound waves received at the microphone 40. The processing circuitry 50 receives the electronic signal and takes corresponding action, for instance, transmitting data representing the electronic signal to a network or other device. In one embodiment, microphone 40 is comprised of a MEMS or electret microphone with an opening communicating with cavity 34. In some embodiments, the opening is as large as the diaphragm of microphone 40. As such, if the diaphragm is flush with the side walls, the opening is not well defined, in which case the diaphragm more directly communicates with cavity 34 and/or passageways 32, rather than via a microphone opening per se.

As set forth above, FIG. 3 shows an embodiment of an audio device 2 with a particularly configured passageway set 30. Specifically, FIG. 3 shows an audio device 2 with a housing 4. The housing 4 has an external surface 10 at least partially enclosing a cavity in communication with a microphone 40. A first aperture 22-1 and a second aperture 22-2 are defined through the housing 4 for passage of a sound to the cavity 34 and microphone 40. The first aperture 22-1 is defined through the external surface 10 of the housing 4 and connected to a first passageway 32-1 for sound through the external surface 10 and to the cavity 34 and microphone 40. The second aperture 22-2 is defined through the external surface 10 and connected to a second passageway 32-2 for sound through the external surface 10 and to the cavity 34 and microphone 40. The first aperture 22-1 and the second aperture 22-2 are spaced apart on the external surface 10 a first distance 9-1.

FIG. 3 also shows a third aperture 22-2 defined through the housing 4 for passage of a sound to the microphone 40 via cavity 34. The third aperture 22-3 is defined through the external surface 10 of the housing 4 and connected to a third passageway 32-3 for sound through the external surface 10 and to the microphone 40. The second aperture 22-2 and the third aperture 22-3 are spaced apart on the external surface 10 a second distance 9-2.

FIG. 6 shows a first aperture 22-1 and a second aperture 22-2 defined through the external surface 10 of the housing 4 and connected to cavity 34. Similarly, FIG. 6 also shows a third aperture 22-3 and a fourth aperture 22-4 connected to the cavity 34, though any number of apertures may be connected to the cavity 34. Consequently, with combined reference to FIG. 3 and FIG. 6, any number of apertures may be implemented as desired by a person having ordinary skill in the art.

FIG. 6 also illustrates path lengths 36 between each aperture 22 through the cavity 34 and to the microphone 40. The apertures 22 (i.e., 22-1, 22-2, 22-3 and 22-4) and microphone 40 are preferably arranged with respect to each other such that each of the path lengths 36 (i.e., 36-1, 36-2, 36-3 and 36-4) are substantially similar to one another and none of the path lengths 36 is greater than about twice the amount of spacing between apertures 22. In other embodiments, none of the path lengths 36 is greater than by about the amount of spacing between apertures 22. In these and other embodiments, none of the path lengths 36 is less than about half the amount of spacing between apertures 22. It should be noted that these example dimensions of path lengths from apertures 22 to microphone 40 relative to spacing between apertures 22 can also apply to the embodiment shown in FIG. 3.

Still further, although not shown directly in FIG. 6, there is also preferably a limit to variations in the distance from the source of the speech to the apertures 22. Overall, the combined range of path lengths from speech source to microphone diaphragm (e.g. from speech source to aperture 22 to diaphragm of microphone 40) should be within ±¼ of a wavelength of the highest frequency of speech to preserve. Using an example of 8 kHz speech bandwidth, this requires variations in overall path lengths via apertures 22 to stay within ±10 mm of each other (340 m/sec speed of sound divided by 8000 Hz frequency divided by 4=10.6 mm). As set forth above, these overall path lengths include both the distance from speech source (e.g. mouth of a talker) to the aperture 22 on device 2, and the distance from the aperture through any passageway or cavity to arrive at the microphone 40 opening. In this regard, some embodiments could use longer passageways for apertures nearer to the mouth, and shorter passageways for apertures farthest from the mouth to keep all paths within the length restriction.

Figure 4:
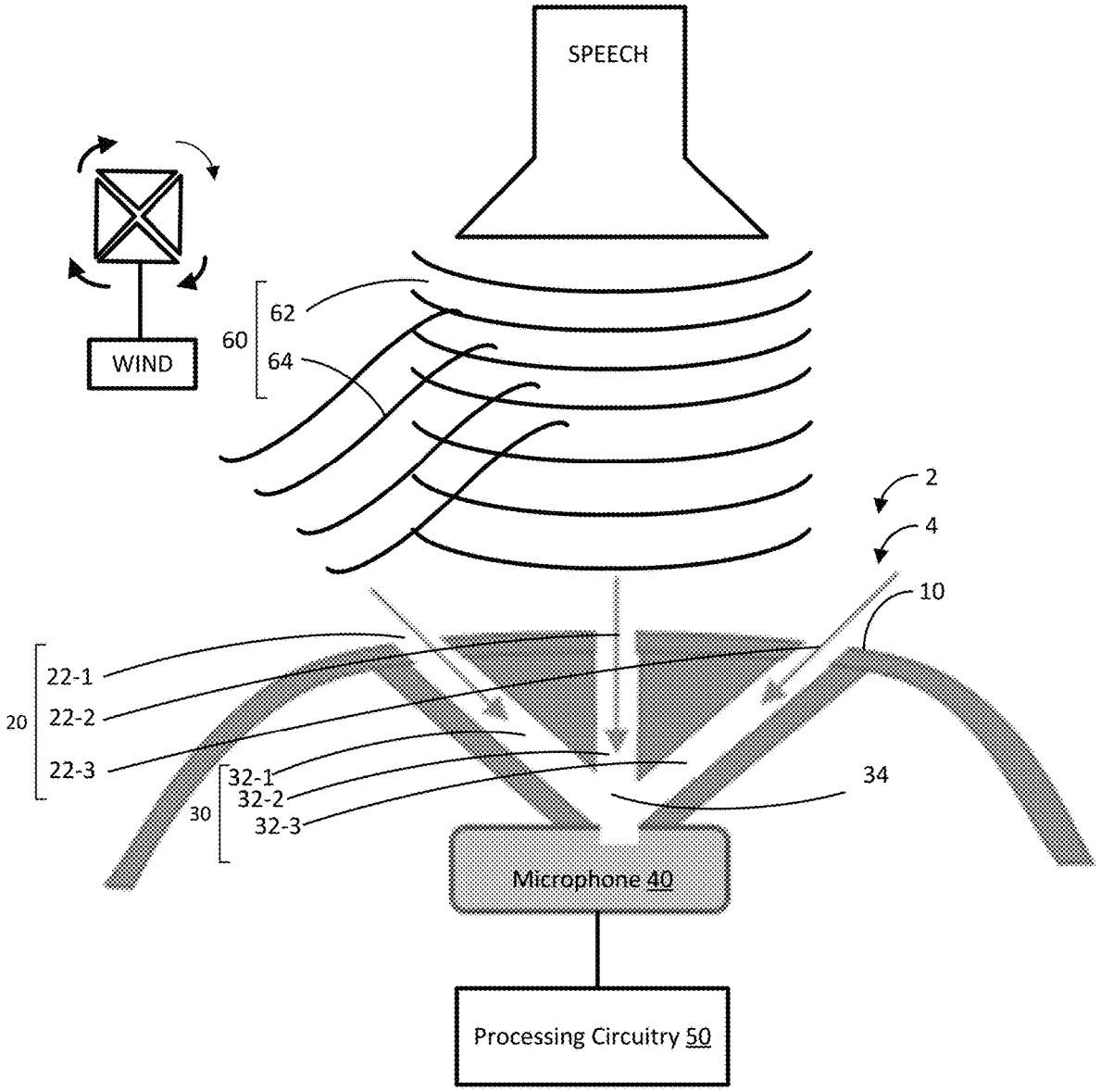
FIG. 4 depicts the example cutaway side view of the embodiment of the audio device according to FIG. 3 in connection with a sound having a desired component and an undesired component, in accordance with various embodiments.

Maintaining reference to FIG. 3, but with additional reference to FIG. 4, the first aperture 22-1 and the second aperture 22-1 are configured to receive a sound 60 comprising a desired (speech) component 62 and an undesired (wind) component 64. The first passageway 32-1 and the second passageway 32-2 conduct the sound 60 along different paths to the cavity 34 and microphone 40 whereby the undesired (wind) component 64 is attenuated at the microphone 40 relative to the desired (speech) component 62. A summation of a first portion of the sound 60 passing through the first aperture 22-1 and a second portion of the sound 60 passing through the second aperture 22-2 attenuates the undesired (wind) component 64 of the sound relative to a desired component 62 of the sound 60.

Additionally, FIG. 4 shows a third aperture 22-3 and a third passageway 32-3. The third aperture 22-3 is configured to receive the sound 60 comprising the desired (speech) component 62 and the undesired (wind) component 64, also. The third passageway 32-3 conducts the sound 60 along a different path to the cavity 34 and microphone 40 whereby the undesired (wind) component 64 is attenuated at the microphone 40 relative to the desired (speech) component 62. The summation of a first portion of the sound 60 passing through the first aperture 22-1 and a second portion of the sound 60 passing through the second aperture 22-3 and a third portion of the sound 60 passing through the third aperture 22-3 attenuates the undesired (wind) component 64 of the sound relative to the desired component 62 of the sound 60.

Figure 5:
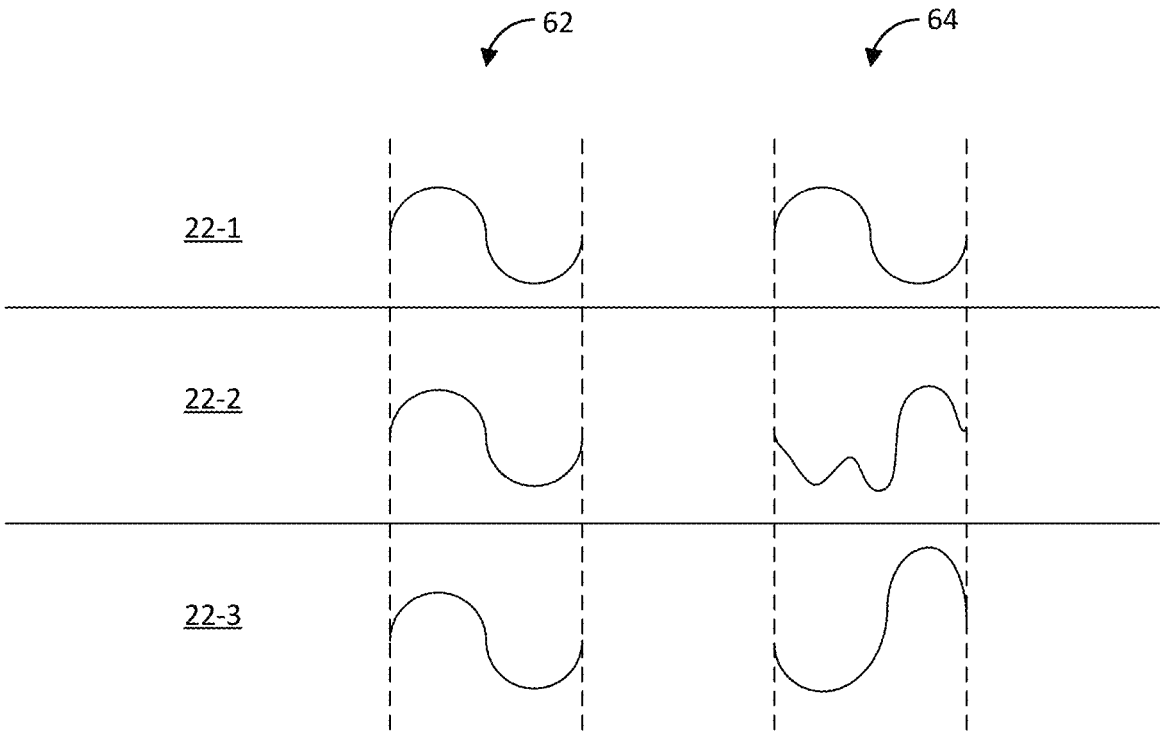
FIG. 5 illustrates operative principles of the example embodiment of FIGS. 3 and 4.

FIG. 5 shows an example illustration of the effect of the disclosed system or method on the sound 60. For instance, the desired (speech) component 62 is shown exhibiting correlated behavior at first aperture 22-1, second aperture 22-2 and third aperture 22-3. The undesired (wind) component 64 is shown exhibiting uncorrelated behavior at first aperture 22-1, second aperture 22-2, and third aperture 22-3. The summation or mixing of these uncorrelated components at the microphone 40 causes relative attenuation of the undesired (wind) component 64.

In past systems, grills of cloth, plastic, or metal have been used to extend over an opening for a microphone to protect the microphone from fingers, dirt, and wind, such mesh or grid material includes very closely spaced openings. These grills fail to provide the beneficial attenuation of uncorrelated noise discussed herein. In general, as air flows across a surface, turbulence and whirling or traveling vortices resulting from the turbulence create random fluctuations in air pressure across that surface. Consequently, uniquely varying air pressure patterns emerge occurring at each point along the surface. In contrast, as speech travels from a speaker to a microphone, the speech proceeds relatively unaffected by wind and alternations in local sound pressure caused by reflections from nearby objects generally create stationary (e.g., not fluctuating) changes in loudness and phase as the sound reaches the surface, but does not generally create variations in correlation relative to other points across the surface. Consequently, by providing holes spaced as recited herein, differential filtering of the uncorrelated sound from wind versus the correlated sound from speech may be obtained when the sound portions received from all the apertures are combined in the cavity near the microphone.

Figure 7:
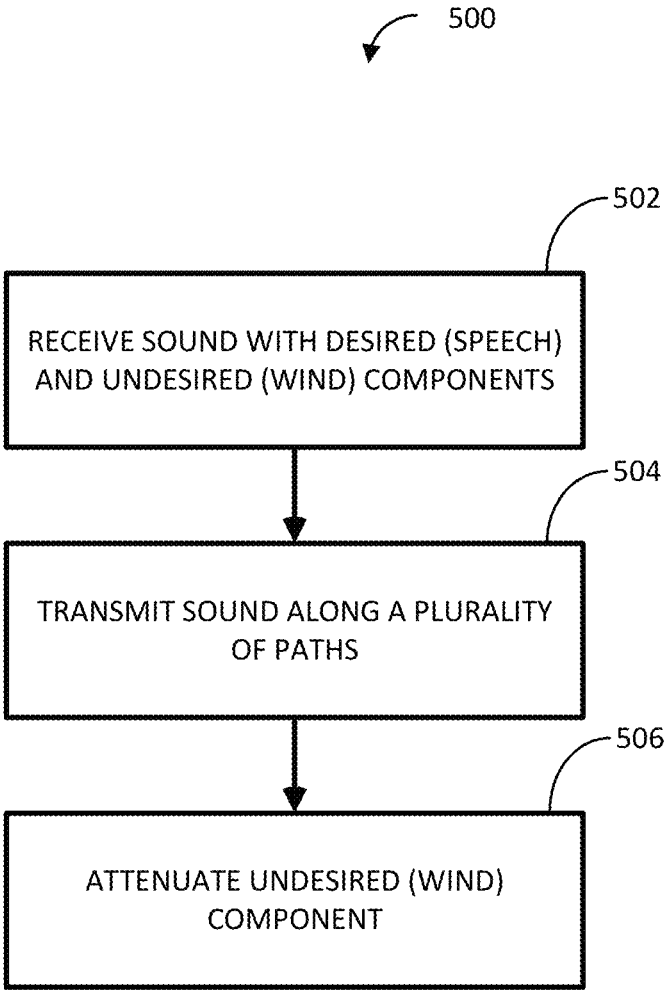
FIG. 7 depicts a method of providing an audio device having multi-port wind noise protection, in accordance with various embodiments.

Directing attention to FIGS. 1-6 and also referencing FIG. 7, a method of multi-port wind noise protection 500 is provided. An audio device may receive a sound with a desired (speech) component and an undesired (wind) component (block 502). One or more passageways may transmit the sound from a plurality of apertures, thus providing the sound along a plurality of paths to the microphone (block 504). The portions of the sound from each aperture may mix, combine or sum together at the microphone, attenuating the undesired (e.g., wind) component (block 506). Stated differently, a signal to noise ratio between the desired component and undesired component is improved at the microphone.

As used herein, the singular terms "a," "an," and "the" may include plural references unless the context clearly dictates otherwise. Additionally, amounts, ratios, and other numerical values are sometimes presented herein in a range format. It is to be understood that such range format is used for convenience and brevity and should be understood flexibly to include numerical values explicitly specified as limits of a range, but also to include all individual numerical values or sub-ranges encompassed within that range as if each numerical value and sub-range is explicitly specified.

While the present disclosure has been described and illustrated with reference to specific embodiments thereof, these descriptions and illustrations do not limit the present disclosure. It should be understood by those skilled in the art that various changes may be made and equivalents may be substituted without departing from the true spirit and scope of the present disclosure as defined by the appended claims. The illustrations may not be necessarily drawn to scale.

There may be distinctions between the artistic renditions in the present disclosure and the actual apparatus due to manufacturing processes and tolerances. There may be other embodiments of the present disclosure which are not specifically illustrated. The specification and drawings are to be regarded as illustrative rather than restrictive. Modifications may be made to adapt a particular situation, material, composition of matter, method, or process to the objective, spirit and scope of the present disclosure. All such modifications are intended to be within the scope of the claims appended hereto. While the methods disclosed herein have been described with reference to particular operations performed in a particular order, it will be understood that these operations may be combined, sub-divided, or re-ordered to form an equivalent method without departing from the teachings of the present disclosure. Accordingly, unless specifically indicated herein, the order and grouping of the operations are not limitations of the present disclosure.

The invention claimed is:

1. An audio device comprising:

a housing comprising an external surface at least partially enclosing a cavity;

a microphone having an opening in communication with the cavity;

a first aperture through the external surface and acoustically connected to the cavity by a first passageway; and a second aperture through the external surface and acoustically connected to the cavity by a second passageway, a third aperture through the external surface and acoustically connected to the cavity by a third passageway, the first aperture, the second aperture and the third aperture are spaced apart from one another on the external surface of the housing, wherein a wind component of sound propagated to the cavity via the first passageway, the second passageway, and the third passageway is attenuated at the microphone relative to a speech component of the sound.

2. The audio device of claim 1, wherein the first passageway, the second passageway and the third passageway are separate passageways that converge at the cavity.

3. The audio device of claim 1, wherein the first passageway, the second passageway, and the third passageway are tubular.

4. The audio device of claim 1, wherein a spacing between the first aperture, the second aperture and the third aperture is at least about three millimeters.

5. The audio device of claim 1 is part of a headset.

6. The audio device of claim 1, wherein the housing is at least partially insertable in a human ear.

7. An audio device comprising:

a housing comprising an external surface at least partially enclosing a cavity;

a microphone disposed in the housing and in acoustic communication with the cavity; and a plurality of apertures disposed through the external surface of the housing and acoustically coupled to the cavity by corresponding sound passageways, each of the corresponding passageways are separate, a length of sound paths through the sound passageway between each of the plurality of apertures and the cavity are substantially similar and the length of the sound paths are less than twice the spacing between the apertures, and wherein a wind component of sound propagating through the passageways is attenuated at the cavity relative to a speech component of the sound.

8. The audio device of claim 7, wherein the plurality of apertures are spaced apart by not less than about 3 millimeters from center-to-center.

9. The audio device of claim 7, wherein the plurality of apertures comprises at least three apertures.

10. The audio device of claim 7, wherein the plurality of apertures comprises at least two apertures.

11. The audio device of claim 7, wherein the plurality of passageways are tubular.

12. The audio device of claim 9, wherein the plurality of apertures are spaced apart from one another on the external surface of the housing by at least about three millimeters measured between a center of the apertures.

13. The audio device of claim 7 is part of a headset.

14. An audio device comprising:

a housing comprising an external surface at least partially enclosing a cavity;

a microphone having an opening in communication with the cavity;

a plurality of apertures including at least a first aperture defined through the external surface and configured to convey a sound through the external surface and to the cavity and a second aperture defined through the external surface and configured to convey the sound through the external surface and to the cavity, wherein the first aperture and the second aperture are spaced apart on the external surface a first distance, and wherein the plurality of apertures and the microphone are arranged such that path lengths between each of the plurality of apertures through the cavity to the microphone are substantially similar and all of the path lengths are less than twice the first distance, and wherein the first aperture and the second aperture are configured to receive the sound comprising a speech component and a wind component, and wherein the first and second apertures convey the sound to the cavity whereby the wind component is attenuated at the cavity relative to the speech component.

15. The audio device of claim 14, wherein the first distance is at least about 3 millimeters measured center-to-center between the first aperture and the second aperture.

16. The audio device of claim 14, wherein the first aperture is about 0.5 mm in diameter and the second aperture is about 0.5 mm in diameter.

17. The audio device of claim 14, wherein the first and second apertures are circular.

18. The audio device of claim 14, wherein the audio device is part of a headset.

19. The audio device of claim 14, wherein the housing of the audio device is at least partially insertable in a human ear.

* * * * *